US008081895B2

(12) United States Patent
Shigezaki et al.

(10) Patent No.: US 8,081,895 B2
(45) Date of Patent: Dec. 20, 2011

(54) IMAGE FORMING APPARATUS WITH VARIABLE SPEED CLEANING MEMBERS AND CLEANING METHOD UTILIZING SAME

(75) Inventors: Satoshi Shigezaki, Kanagawa (JP); Satoya Sugiura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/822,506

(22) Filed: Jul. 6, 2007

(65) Prior Publication Data

US 2008/0159765 A1 Jul. 3, 2008

(30) Foreign Application Priority Data

Dec. 27, 2006 (JP) ..... P.2006-350903

(51) Int. Cl.
*G03G 15/16* (2006.01)

(52) U.S. Cl. ..... 399/71

(58) Field of Classification Search ..... 399/71
See application file for complete search history.

(56) References Cited

U.S. PATENT DOCUMENTS

| | | | | |
|---|---|---|---|---|
| 4,378,421 | A * | 3/1983 | Larson | 430/119.8 |
| 6,014,530 | A * | 1/2000 | Tsunemi | 399/53 |
| 6,108,499 | A * | 8/2000 | Cernusak | 399/26 |
| 7,085,528 | B2 * | 8/2006 | Shintani et al. | 399/350 |
| 2004/0209178 | A1 * | 10/2004 | Itakura et al. | 430/45 |
| 2007/0134035 | A1 * | 6/2007 | Kageyama | 399/346 |
| 2007/0140714 | A1 * | 6/2007 | Kurita et al. | 399/44 |

FOREIGN PATENT DOCUMENTS

| | | | |
|---|---|---|---|
| CN | 1828453 | A | 9/2006 |
| JP | 06059606 | A * | 3/1994 |
| JP | 6-175432 | | 6/1994 |
| JP | 2000131970 | A * | 5/2000 |
| JP | 2003-345212 | | 12/2003 |
| JP | 2005249896 | A * | 9/2005 |
| JP | 2006-146189 | | 6/2006 |

* cited by examiner

*Primary Examiner* — Quana M Grainger
(74) *Attorney, Agent, or Firm* — Morgan, Lewis & Bockius LLP

(57) ABSTRACT

An image forming apparatus includes: a plurality of image carrying members; a plurality of rotation cleaning members disposed for the respective image carrying members and cleaning surfaces of the respective image carrying members through rotation; and a controller that rotates the plurality of rotation cleaning members at different rotation speeds in accordance with wear amounts of the respective image carrying members.

6 Claims, 10 Drawing Sheets

OPERATION FOR CONTROLLING ROTATION OF CLEANING ROLL

HARD (SUBSTANTIALLY NO EFFECT ON WEAR)

SOFT ( EFFECTIVE ON WEAR)

IMAGE FORMING APPARATUS WITH VARIABLE SPEED CLEANING MEMBERS AND CLEANING METHOD UTILIZING SAME

CROSS-REFERENCE TO RELATED APPLICATION

This application is based on and claims priority under 35 USC §119 from Japanese Patent Application No. 2006-350903 filed Dec. 27, 2006.

BACKGROUND (i) Technical Field

The present invention relates to an image forming apparatus and a cleaning method of image carrying members in the image forming apparatus.

(ii) Related Art

In an image forming apparatus using an electrophotographic system, such as a duplicator, a printer and a facsimile, a latent image formed on a surface of an image carrying member is developed to a toner image, and the toner image is transferred and fixed to a medium to attain formation of an image. A toner may remain on the surface of the image carrying member after transferring the toner image, and a cleaning member, i.e., a so-called cleaner, is often disposed for cleaning the surface of the image carrying member. In an image forming apparatus for forming a multi-color image, an intermediate transfer material may be disposed between the image carrying member and the final transfer material, and a cleaning member for cleaning the surface of the intermediate transfer medium after finally transferring may be disposed.

SUMMARY

According to an aspect of the invention, there is provided an image forming apparatus including:

a plurality of image carrying members;

a plurality of rotation cleaning members disposed for the respective image carrying members and cleaning surfaces of the respective image carrying members through rotation; and a controller that rotates the plurality of rotation cleaning members at different rotation speeds in accordance with wear amounts of the respective image carrying members.

BRIEF DESCRIPTION OF THE DRAWINGS

Embodiments of the present invention will be described in detail based on the following figures, wherein:

FIG. 7A is an illustrative view of the wear amount in the image forming apparatus of the embodiment 1, and FIG. 7B is an illustrative view of the wear amount in an image forming apparatus in the background art;

FIGS. 10A and 10B are illustrative views of the wear property of the cleaning blade of the embodiment 2, in which FIG. 10A is an illustrative view of the cleaning blade of the embodiment 2, and FIG. 10B is an illustrative view of a cleaning blade in the background art.

DETAILED DESCRIPTION

Figure 1:
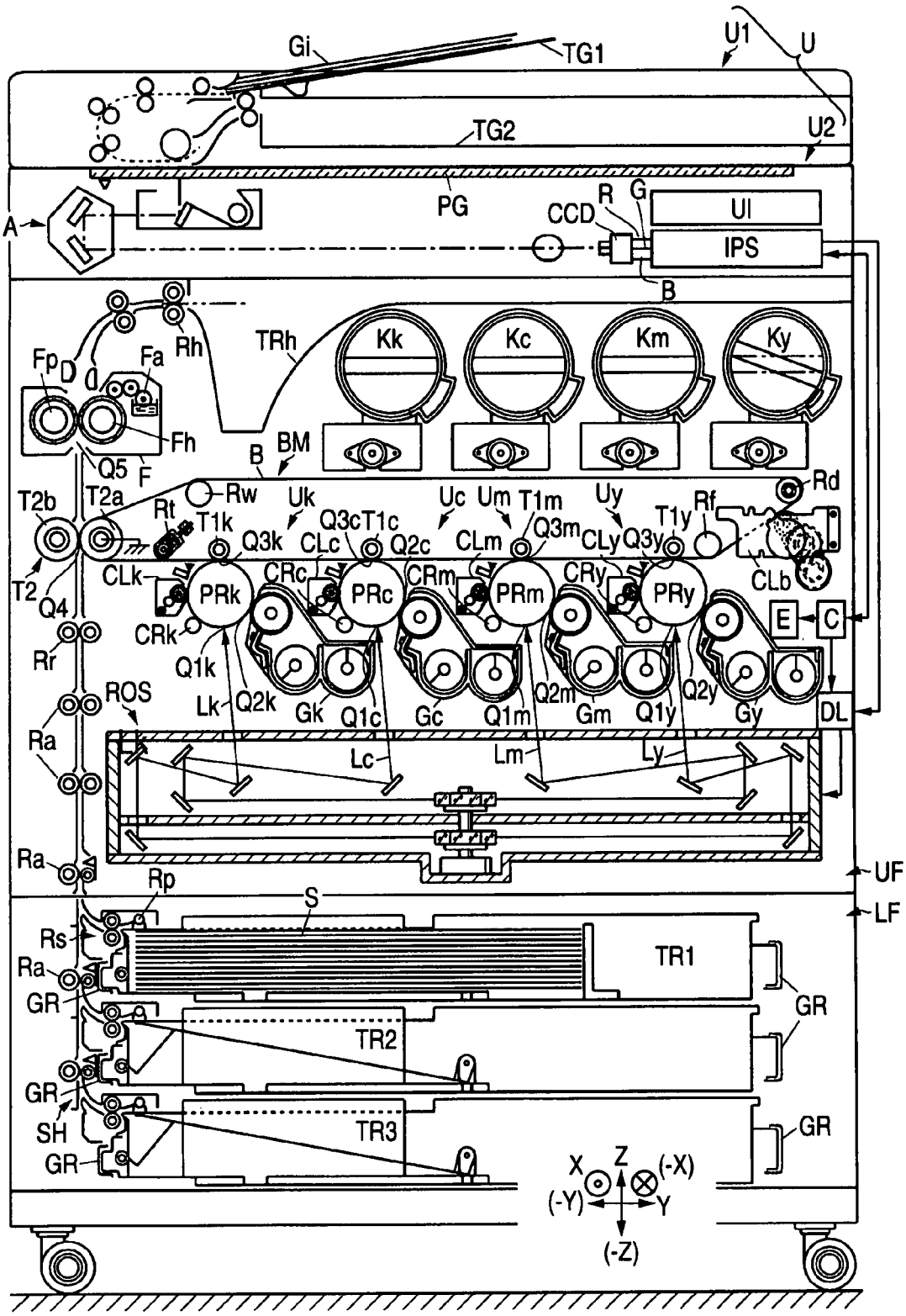
FIG. 1 is an entire illustrative view of an image forming apparatus of an exemplary embodiment 1 of the invention.

Exemplary embodiments of the invention will be described with reference to the drawing, but the invention is not limited to the examples.

In the drawings, for convenience of understanding the following descriptions, the depth direction is referred to as the X axis direction, the horizontal direction is referred to as the Y direction, the vertical direction is referred to as the Z direction, and the directions or sides shown by the arrows X, −X, Y, −Y, Z and −Z are referred to as the forward direction, the backward direction, the right direction, the left direction, the upward direction and the downward direction, or the front side, the back side, the right side, the left side, the upside and the downside, respectively.

In the drawings, the symbol of a circle with a center dot means an arrow directed from the back side to the front side, and the symbol of a circle with an "x" mark means an arrow directed from the front side to the back side.

In the following descriptions using the drawings, members other than those required for description are appropriately omitted from the drawing for convenience of understanding.

Embodiment 1

FIG. 1 is an entire illustrative view of an image forming apparatus of an exemplary embodiment 1 of the invention.

In FIG. 1, an image forming apparatus U has an automatic document feeder U1 and an image forming apparatus main body U2 supporting the document feeder U1 and having a transparent document reading surface PG at the upper end thereof.

The automatic document feeder U1 has a document stacker TG1 having accumulated therein plural documents Gi to be duplicated, and a document delivery tray TG2, to which the documents Gi having been fed from the document stacker TG1 and passed through the document reading position on the document reading surface PG are delivered.

The image forming apparatus main body U2 has an operation part UI, through which a user input operation instructions, such as start of image formation operation, an exposure optical system A, and the like.

Light reflected from the document fed to the document reading surface PG with the automatic document feeder U2 or the document manually placed on the document reading surface PG is converted to electric signals of R (red), G (green) and B (blue) with a solid imaging device CCD through the exposure optical system A.

The image information converting part IPS converts the RGB electric signals input from the solid imaging device CCD to image information of K (black), Y (yellow), M (magenta) and C (cyan), which are temporarily stored therein, and then outputs the image information as image information for forming a latent image to a latent image forming device driving circuit DL at prescribed timing.

In the case where the document image is a single color image, i.e., a monochrome image, only image information of K (black) is input to the latent image forming device driving circuit DL.

The latent image forming device driving circuit DL has driving circuits (which are not shown in the figure) for respective colors, Y, M, C and K, and outputs laser driving signals corresponding to the input image information to latent image writing laser diodes (which are not shown in the figure) for the respective colors of the latent image forming device ROS at prescribed timing.

Figure 2:
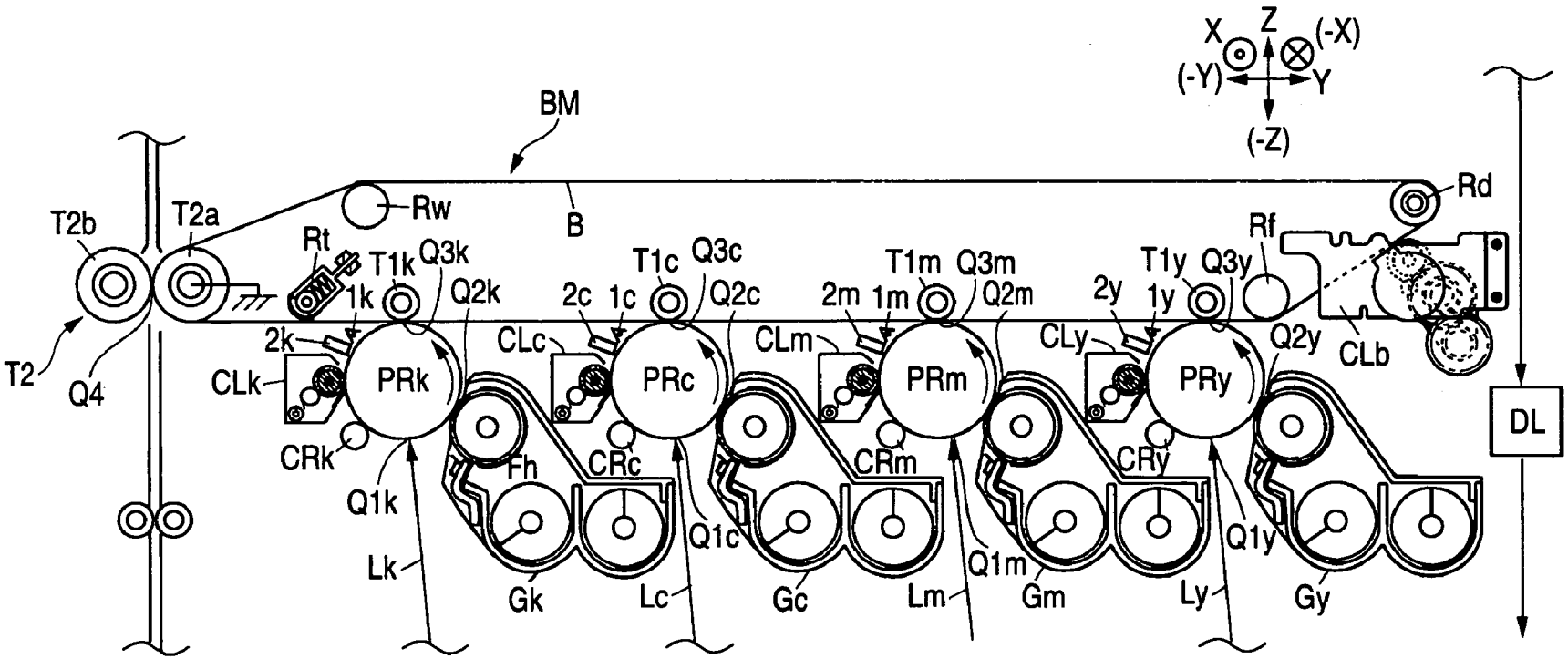
FIG. 2 is an illustrative enlarged view of a main part of an image forming apparatus of the embodiment 1.

FIG. 2 is an illustrative enlarged view of a main part of the image forming apparatus of the embodiment 1.

Visual image forming devices Uy, Um, Uc and Uk disposed above the latent image forming device ROS are devices for forming toner images of respective colors, Y (yellow), M (magenta), C (cyan) and K (black), respectively.

Laser beams Ly, Lm, Lc and Lk as examples of latent image writing light of Y, M, C and K emitted from the laser diodes of the latent image forming device ROS are incident on rotating image carrying members PRy, PRm, PRc and PRk, respectively.

The visual image forming device Uy for Y has the rotating image carrying member PRy, a charging device CRy, a developing device Gy, a transferring device T1*y*, a precleaning corotron 1*y* as an example of a destaticizing device before cleaning, a photodestaticizing device 2*y* and an image carrying member cleaner CLy, and the visual image forming devices Um, Uc and Uk are constituted as similar to the visual image forming device Uy for Y.

In FIGS. 1 and 2, the image carrying members PRy, PRm, PRc and PRk are uniformly charged with the charging devices CRy, CRm, CRc and CRk, respectively, and then electrostatic latent imaged are formed on the surfaces thereof with the laser beams Ly, Lm, Lc and Lk at image writing positions Q1*y*, Q1*m*, Q1*c* and Q1*k*. The electrostatic latent images on the surfaces of the image carrying members PRy, PRm, PRc and PRk are developed to toner images as an example of a visual image with the developing device Gy, Gm, Gc and Gk at developing areas Q2*y*, Q2*m*, Q2*c* and Q2*k*.

The toner images thus developed are conveyed to primary transfer area Q3*y*, Q3*m*, Q3*c* and Q3*k*, which are in contact with an intermediate transfer belt B as an example of an intermediate transfer material. Primary transferring devices T1*y*, T1*m*, T1*c* and T1*k* disposed on the back side of the intermediate transfer belt B at the primary transfer areas Q3*y*, Q3*m*, Q3*c* and Q3*k* are applied with primary transfer voltages having a polarity opposite to the charging polarity of the toner from an electric power circuit E controlled with a controller C at prescribed timing.

The toner images on the image carrying members PRy to PRk are primarily transferred to the intermediate transfer belt B with the primary transferring devices T1*y*, T1*m*, T1*c* and T1*k*. The toner remaining on the surfaces of the image carrying members PRy, PRm, PRc and PRk after primarily transferring is cleaned with the image carrying member cleaners CLy, CLm, CLc and CLk. The surfaces of the image carrying members PRy, PRm, PRc and PRk are destaticized with the precleaning corotron 1*y*, 1*m*, 1*c* and 1*k* and the photodestaticizing device 2*y*, 2*m*, 2*c* and 2*k*, and then again charged with the charging devices CRy, CRm, CRc and CRk.

A belt module BM as an example of an intermediate transferring device capable of being moved vertically and of drawn to the front side is disposed above the image carrying members PRy to PRk. The belt module BM has an intermediate transfer belt B as an example of an intermediate transfer material, a belt driving roll Rd as an example of an intermediate transfer material driving member, a tension roll Rt as an example of an intermediate transfer medium stretching member, a walking roll Rw as an example of a meandering preventing member, an idler roll (free roll) Rf as an example of a driven member, belt supporting rolls (Rd, Rt, Rw, Rf and T2*a*) as an example of an intermediate transfer material supporting member including a backup roll T2*a* as an example of a secondary transfer area opposing member, and the primary transferring devices T1*y*, T1*m*, T1*c* and T1*k*. The intermediate transfer belt B is rotationally and movably supported by the belt supporting rolls (Rd, Rt, Rw, Rf and T2*a*).

A secondary transfer roll T2*b* as an example of a secondary transfer member is disposed to face the surface of the intermediate transfer belt B in contact with the backup roll T2*a*, and a secondary transferring device T2 is constituted by the rolls T2*a* and T2*b*. A secondary transfer area Q4 is formed in an area where the secondary transferring device T2*b* and the intermediate transfer belt B face each other.

The monochrome or multi-color toner image transferred and accumulated on the intermediate transfer belt B by the transferring devices T1*y*, T1*m*, T1*c* and T1*k* in the primary transfer areas Q3*y*, Q3*m*, Q3*c* and Q3*k* is conveyed to the secondary transfer area Q4.

Three sets of pairs of guide rails GR as an example of a guide member supporting paper feeding trays TR1 to TR3 as an example of a paper feeding container drawably in the depth direction (X axis direction) are provided under the latent image forming device ROS. Recording sheets S as an example of a medium housed in the paper feeding trays TR1 to TR3 are taken out with a pickup roll Rp as an example of a medium taking up member and separated into respective sheets with a handling roll Rs as an example of a medium handling member. The recording sheet is conveyed with plural conveying rolls Ra as an example of a medium conveying member along a sheet conveying path SH as an example of a medium conveying path, and sent to a register roll Rr as an example of a member for controlling delivery timing to the transfer area disposed on an upstream side of the secondary transfer area Q4 in the sheet conveying direction. A sheet conveying device (SH+Ra+Rr) is constituted by the sheet conveying path SH, the sheet conveying roll Ra, the register roll Rr and the like.

The register roll Rr delivers the recording sheet S to the secondary transfer area Q4 at such timing that is conformed to the delivery of the toner image formed on the intermediate transfer belt B to the secondary transfer area Q4. Upon passing the recording sheet S through the secondary transfer area Q4, the backup roll T2*a* is grounded, and the secondary transferring device T2*b* is applied with a secondary transfer voltage having a polarity opposite to the charging polarity of the toner from an electric power circuit E controlled with the controller C at prescribed timing. At this time, the color toner image on the intermediate transfer belt B is transferred to the recording sheet S with the secondary transferring device T2.

The intermediate transfer belt B after completing the secondary transfer is cleaned with a belt cleaner CLb as an example of an intermediate transfer medium cleaner.

The recording sheet S having the toner image having been secondarily transferred thereon is conveyed to a fixing area Q5, which is a pressurizing area of a pressure roll Fp as an example of a pressure fixing member and a heating roll Fh as an example of a heat fixing member of a fixing device F, and is subjected to heat fixing upon passing through the fixing area. The recording sheet S having been subjected to heat fixing is discharged to a paper catch tray Rh as an example of a medium discharge part with a discharge roller Rh as an example of a medium discharging member.

The surface of the heating roll Fh is coated with a releasing agent with a releasing agent coating device Fa for improving the releasing property of the recording sheet S from the heating roll.

Developer cartridges Ky, Km, Kc and Kk as an example of a developer feeding container housing developers of Y (yellow), M (magenta), C (cyan) and K (black) are disposed above the belt module BM. The developers housed in the developer cartridges Ky, Km, Kc and Kk are fed to the developing devices Gy, Gm, Gc and Gk through developer feeding paths, which is not shown in the figure, corresponding to consumption of the developer in the developing devices Gy, Gm, Gc and Gk.

In the embodiment 1, the developers are externally added with irregular inorganic particles having a Mohs hardness of 3 or more and a volume average particle diameter of about from 0.1 to 1.0 μm.

The Mohs hardness is obtained by using a Mohs hardness meter. This has been developed by F. Mohs, in which a specimen is scratched with the following ten mineral substances in sequence, and it is determined that the hardness of the specimen is lower than that of the mineral substance that makes scratch on the specimen. The mineral substances are from lower hardness talc (1), gypsum (2), calcite (3), fluorite (4), apatite (5), orthoclase (6), quartz (7), topaz (8), corundum (9) and diamond (10). The volume average particle diameter is such a particle diameter that is obtained at an accumulate of 50% when an cumulative distribution is drawn from the small particle diameter side for the particle size ranges (channels) obtained by dividing the particle size distribution, and is measured with a known apparatus for measuring a volume average particle diameter.

The irregular inorganic particles are not particularly limited as far as they have the aforementioned characteristics, and the following materials are exemplified. Preferred examples thereof include various inorganic oxides, nitrides, borides and the like, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boron nitride, calcium carbonate, magnesium carbonate and calcium phosphate.

In FIG. 1, the image forming apparatus U has an upper frame UF and a lower frame LF, and the upper frame UF supports the latent image forming device ROS and the members (the image carrying members PRy, PRm, PRc and PRk, the developing devices Gy, Gm, Gc and Gk, the belt module. BM and the like) disposed above the latent image forming device ROS.

The lower frame LF supports the guide rails GR supporting the paper feeding trays TR1 to TR3 and the paper feeding member (the pickup roll Rp, the handling roll Rs, the sheet conveying roll Ra and the like) for feeding paper from the trays TR1 to TR3.

(Description of Image Carrying Member)

Figure 3:
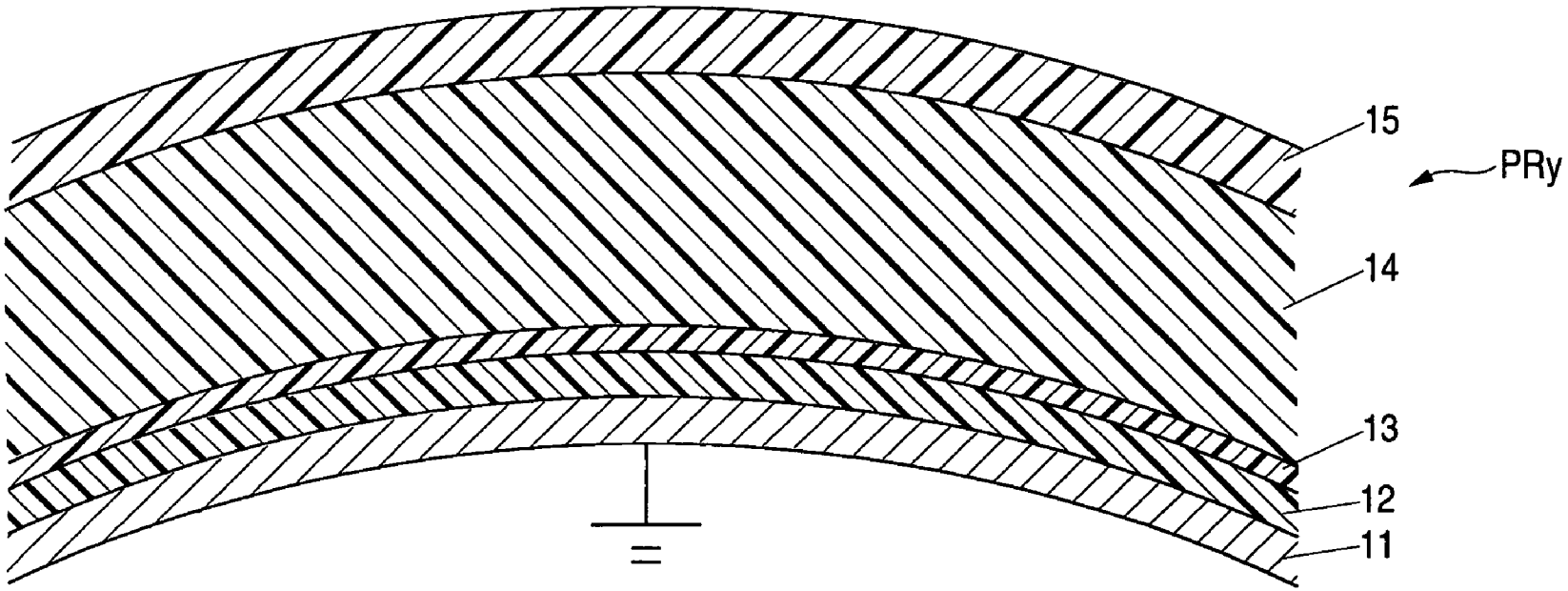
FIG. 3 is an illustrative view of an image carrying member of the embodiment 1.

FIG. 3 is an illustrative view of the image carrying member of the embodiment 1.

The constitution of the image carrying members PRy, PRm, PRc and PRk of the embodiment 1 will be described, but since the image carrying members PRy, PRm, PRc and PRk for respective colors are constituted similarly to each other, only the image carrying member PRy of Y color is described, and detail descriptions for the other image carrying members PRm, PRc and PRk are omitted.

In FIG. 3, the image carrying member PRy of the embodiment 1 has a grounded aluminum base material 11 formed of aluminum. An undercoating layer 12 is formed on the surface of the base material, and a charge generating layer 13 is formed outside the undercoating layer 12. A charge transporting layer 14 is formed on the surface side of the charge generating layer 13, and a protective layer 15 is formed on the surface side of the charge transporting layer 14.

A production method of the image carrying member PRy of the embodiment 1 is exemplified below.

To 170 parts by weight of n-butyl alcohol having 4 parts by weight of a polyvinyl butyral resin (S-Lec BM-S, a trade name, produced by Sekisui Chemical Co., Ltd.) dissolve therein, 30 parts by weight or an organic zirconium compound (acetylacetone zirconium butylate) and 3 parts by weight of an organic silane compound (γ-aminopropyltrimethoxysilane) are added, followed by mixing and agitating, to produce a coating composition for forming an undercoating layer. The coating composition is coated on a surface of a aluminum base material 11 having an outer diameter of 84 mm having been roughened by a honing treatment, and after air drying at room temperature for 5 minutes, the base material 11 is heated to 50° C. over 10 minutes and subjected to a hydration curing acceleration treatment by placing in a high temperature and high humidity bath at 50° C. 85% RH (dew point: 47° C.) for 20 minutes. Thereafter, the base material is dried by placing in a hot air dryer at 160° C. for 15 minutes to form an undercoating layer on the base material 11.

A mixture containing 15 parts by weight of gallium phthalocyanine chloride as a charge generating material, 10 parts by weight of a vinyl chloride-vinyl acetate copolymer resin (VMCH, produced by Nippon Unicar Co. Ltd.) and 300 parts by weight of n-butyl alcohol is dispersed with a sand mill for 4 hours. The dispersion liquid thus obtained is coated on the undercoating layer 12 and dried to form a charge generating layer 13 having a thickness of 0.25 μm.

A coating composition, which is obtained by sufficiently dissolving and mixing 40 parts by weight of N,N'-bis(3-methylphenyl)-N,N'-diphenylbenzidine and 60 parts by weight of a bisphenol Z polycarbonate resin (molecular weight: 40,000) in 230 parts by weight of tetrahydrofuran and 100 parts by weight of monochlorobenzene, is coated on the surface of the charge generating layer 13 and dried at 115° C. for 40 minutes to form a charge transporting layer 14 having a thickness of 22 μm.

2 parts by weight of the following compound and 2 parts by weight of Resitop PL4852 (produced by Gunei Chemical Industry Co., Ltd.) are dissolved in 10 parts by weight of isopropyl alcohol to obtain a coating composition for forming a protective layer. The coating composition for forming a protective layer is coated on the surface of the charge transporting layer 14 and air-dried at room temperature for 20 minutes and at 145° C. for 40 minutes to form a protective layer 15 having a charge transporting function having a thick ness of 4 μm, whereby the image carrying member PRy has been produced.

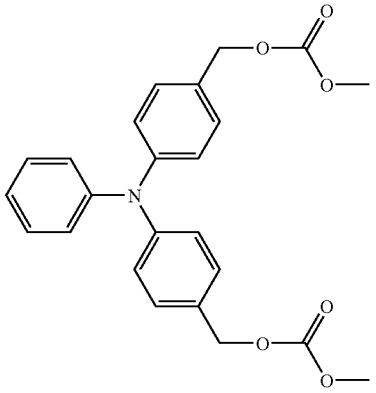

Accordingly, upon irradiating the image carrying member PRy with laser light Ly under such a state that the surface is charged with the charging device CRy, charge or hole is generated in the charge generating layer 13, and the charge is transported through the charge generating layer 14 and the protective layer 15 to make an electric current flow on the surface, whereby the charge potential of the part that is irradiated with the laser light Ly is lowered as compared to the part that is not irradiated with the laser light Ly.

(Description of Image Carrying Member Cleaner)

Figure 4:
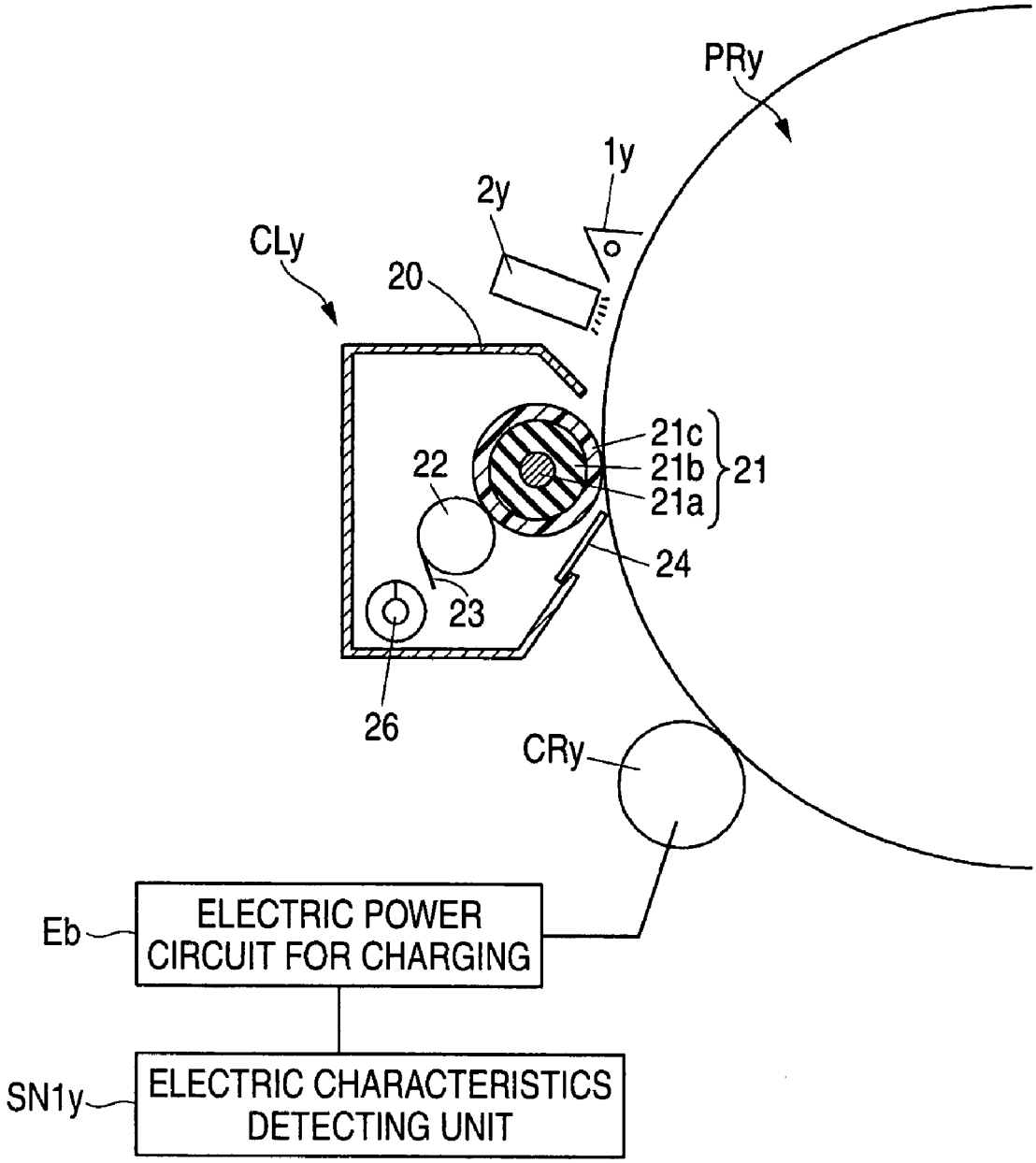
FIG. 4 is an illustrative enlarged view of a main part of an image carrying member cleaner of the embodiment 1.

FIG. 4 is an illustrative enlarged view of a main part of an image carrying member cleaner of the embodiment 1.

The constitution of the image carrying member cleaners CLy, CLm, CLc and CLk, the precleaning corotrons 1*y*, 1*m*, 1*c* and 1*k*, and the photodestaticizing devices 2*y*, 2*m*, 2*c* and 2*k* will be described, but since the image carrying member cleaners CLy, CLm, CLc and CLk and the like for respective colors are constituted similarly to each other, only those for Y color are described, and detail descriptions for those for the other colors are omitted.

In FIG. 4, the image carrying member cleaner CLy of the embodiment 1 has a housing 20 as an example of a cleaner container, and in the housing 20, a cleaning roll 21 as an example of a rotation cleaning member disposed to face the image carrying member PRy is rotatablly supported. The cleaning roll 21 of the embodiment 1 is constituted by a roll having an outer diameter of 12 mm rotationally driven, and is configured to be rotated in the same direction as the image carrying member PRy at the position facing the same. The cleaning roll 21 of the example has a shaft 21*a* having a diameter of 6 mm, an elastic layer 21*b* fixed on the periphery of the shaft 21*a*, and a fiber layer (surface layer) 21*c* having a thickness of 900 μm coated on the surface of the elastic layer.

The shaft 21*a* can be formed of a metal, such as iron and stainless steel, and the elastic layer 21*b* can be constituted by an electroconductive cylindrical roll formed of urethane foam, NBR, SBR, EPDM or the like having an electroconductive material, such as carbon black, mixed therein.

The fiber layer 21*c* may be a nonwoven fabric formed of electroconductive fibers or electroconductive fibers formed in to a cloth by knitting or weaving. The electroconductive fibers herein may be divided fibers of nylon conductive thread having carbon black mixed therein (produced by KB Seiren Co., Ltd.) having, for example, a fiber thickness of 0.5 denier (248 T/450 F). The use of ultrafine electroconductive fibers can increase the surface area of the fiber layer 21*c*, whereby a large amount of a toner can be retained, and the cleaning capability can be improved. In this case, the fiber thickness of the electroconductive fibers is suitably 2 denier (about 15 μm in terms of diameter) or less, and more preferably 1 denier (about 11 μm in terms of diameter) or less, from the standpoint of retaining property of a toner and cleaning property. Nonwoven cloth includes dry-laid nonwoven cloth, wet-laid nonwoven cloth and the like, and dry-laid nonwoven cloth is used in this example. The dry-laid nonwoven cloth is specifically obtained in such a manner that fibers having a fiber length of several centimeter are formed into a thin sheet by a carding machine or an air random machine, and depending on necessity, plural sheets are accumulated. The fibers are bonded by tangling with a high-pressure thin water flow.

The fiber layer 21*c* may be formed of electroconductive fibers mixed with insulating fibers, for example, for improving the durability of the fiber layer 21*c*.

The cleaning roll 21 of the embodiment 1 is applied with a remaining toner removing voltage having a polarity opposite to the charging polarity of the remaining toner. Accordingly, such an electric field is produced that electrostatically moves the remaining toner from the surface of the image carrying member PRy to the cleaning roll 21, so as to remove the remaining toner from the image carrying member PRy. Attachments on the image carrying member PRy, such as discharge products, paper powder and dusts, are also removed with the cleaning roll 21.

A collecting roll 22 as an example of a collecting member for collecting the developer removed by the cleaning roll 21 is dispose to be in contact with the cleaning roll 21, and a scraper 23 as an example of a scraping member for scraping the toner attached to the surface of the collecting roll 22 is disposed on the collecting roll 22.

The collecting roll 22 is formed, for example, of a phenol resin having a resistance value adjusted by dispersing carbon black therein. A metallic material, such as iron and stainless steel, may be used, and a coating of a fluorine resin or the like may be provided for smoothing the contact with the scraper 23 and for improving the releasing property of the toner.

The collecting roll 22 is applied with a remaining toner collecting voltage generating such an electric field that electrostatically moves the toner on the surface of the cleaning roll 21 to the collecting roll 22.

A cleaning blade 24 as an example of a scraping member for scraping the remaining toner from the surface of the image carrying member PRy is disposed on the downstream side of the cleaning roll 21 in the rotation direction of the image carrying member PRy.

The toner collected from the cleaning roll 21 with the collecting roll 22, and the toner scraped with the scraper 23 and the toner scraped with the cleaning blade 24 are conveyed with a waste toner conveying auger 26 as an example of a waste developer conveying member, and collected in a waste developer collecting container, which is not shown in the figure.

The image carrying member cleaner CLy of the embodiment 1 is constituted by the members attached with the symbols 21 to 26.

(Description of Charging Device)

In FIG. 4, the charging device CRy of the embodiment 1 is constituted by a contact type charging roll, and the charging device CRy is applied with a charging voltage for charging the surface of the image carrying member PRy from an electric power circuit Eb for charging. In the embodiment 1, a charging voltage containing a direct current with an alternating current accumulated thereon is used as the charging voltage, which is controlled to a constant electric current.

The electric power circuit Eb for charging is connected with an electric characteristics sensor SN1*y* for detecting the voltage-current characteristics between the image carrying member PRy, which is changed in electric characteristics, such as a resistance value, by wear of the surface with the lapse of time, and the charging device CRy. The electric characteristics sensor SN1*y* of the embodiment 1 detects the voltage-current characteristics by detecting the peak voltage of the alternating current voltage of the charging voltage, which is controlled to a constant electric current.

(Description of Controller of Embodiment 1)

Figure 5:
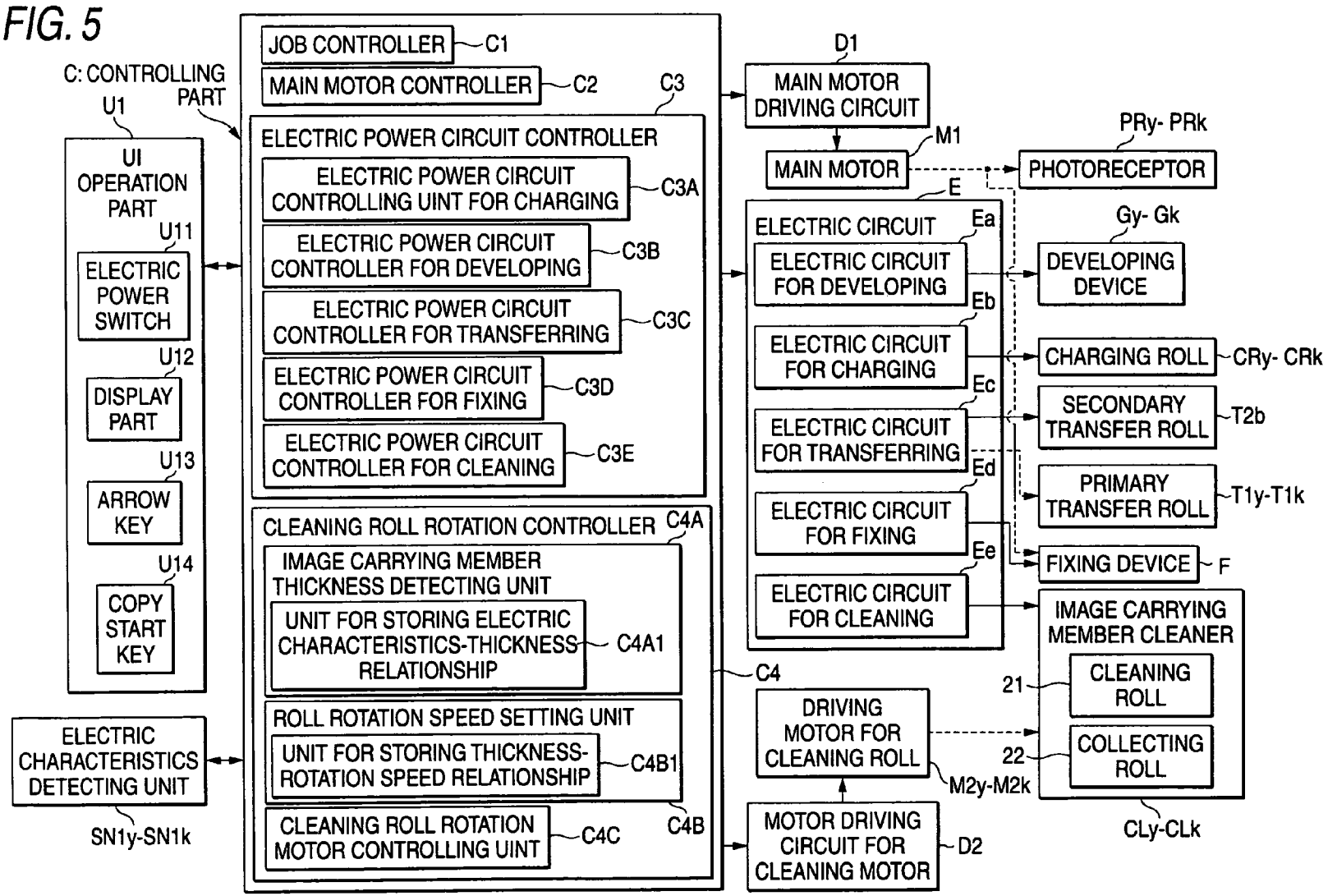
FIG. 5 is a block diagram showing a controller of an image forming apparatus of the embodiment 1.

FIG. 5 is a block diagram showing a controller of the image forming apparatus of the embodiment 1.

The controller C in FIG. 5 is constituted by an input/output interface I/O, ROM (read only memory) having stored therein programs and data for conducting necessary operations, RAM (random access memory) for temporarily storing necessary data, CPU (central processing unit) for conducting operations corresponding to the programs stored in the ROM, and a microcomputer having a clock oscillator, and can realize various functions by conducting the programs stored in the ROM.

(Signal Output Units Connected to Controller C)

Output signals from the operation part UI and a signal output unit, such as the electric characteristics sensors SN1*y* to SN1*k*, are input to the controller C.

The operation part UI has an electric power switch UI1, a display part UI2, an arrow key UI3 and a copy start key UI4 as examples of input keys, and the like.

The electric characteristics sensors SN1*y* to SN1*k* detect the voltage-current characteristics of the image carrying members PRy to PRk and the charging devices of CRy to CRk of the respective colors.

(Units Connected to and Controlled by Controller C)

The controller C is connected to a main motor driving circuit D1, an electric power circuit E, a motor driving circuit D2 for a cleaning motor, and other controlled units, which are not shown in the figure, and outputs operation controlling signals for them.

The main motor driving circuit D1 rotationally drives the image carrying members PRy to PRk, the intermediate transfer belt B and the like through a main motor M1.

The electric power circuit E has an electric power circuit Ea for developing, an electric power circuit Eb for charging, an electric power circuit Ec for transferring, an electric power circuit Ed for fixing, an electric power circuit Ee for cleaning, and the like.

The electric power circuit Ea applies a development bias to the developing rolls of the developing devices Gy to Gk.

The electric power circuit Eb for charging applies a charging voltage for charging the surfaces of the image carrying members PRy to PRk to the charging devices CRy to CRk, respectively.

The electric power circuit Ec applies a transfer bias to the primary transfer rolls T1*y* to T1*k* and the secondary transfer roll T2*b*.

The electric power circuit Ed supplies an electric power source for heating to the heating roll Fh of the fixing device F.

The electric power circuit Ee applies a remaining toner removing voltage or a remaining toner collecting voltage to the cleaning rolls 21 and the collecting rolls 22 of the image carrying member cleaners CLy to CLk.

The motor driving circuit D2 for a motor for driving the cleaning roll rotationally drives the cleaning rolls 21 by driving motors M2*y* to M2*k* for driving the cleaning rolls.

(Functions of Controller C)

The controller C conducts an operation corresponding to the input signal from the signal input unit to output a control signal to the controlled unit. The controller C has the following functions.

C1: Job Controller

The job controller C1 as an example of an image forming operation controller controls the operation of the members of the image forming apparatus U and the application timings of the voltages therein in response to input to the copy start key UI4, so as to conduct a job as the image forming operation.

C2: Main Motor Controller

The main motor controller C2 controls the operation of the main motor M1 through the main motor driving circuit D1, so as to control the operations of the image carrying members PRy to PRk and the like.

C3: Electric Power Circuit Controller

The electric power circuit controller C3 has an electric power circuit controller C3A for developing, an electric power circuit controller C3B for charging, an electric power circuit controller C3C for transferring, an electric power circuit controller C3D for fixing, and an electric power circuit controller C3E for cleaning, and controls the electric power circuit E to control the application of the voltages to the members and the supply of the electric power to them.

C3A: Electric Power Circuit Controller for Developing

The electric power circuit controller C3A for developing controls the electric power circuit Ea for developing to control the developing voltage applied to the developing rolls of the developing devices Gy to Gk.

C3B: Electric Power Circuit Controller for Charging

The electric power circuit controller C3B for charging controls the electric power circuit Eb for charging to control the charging voltage applied to the charging rolls CRy to CRk.

C3C: Electric Power Circuit Controller for Transferring

The electric power circuit controller C3C for transferring controls the electric power circuit Ec for transferring to control the primary transfer voltage applied to the primary transfer rolls T1*y* to T1*k* and the secondary transfer voltage applied to the secondary transfer roll T2*b*.

C3D: Electric Power Circuit Controller for Fixing

The electric power circuit controller C3D for fixing controls the electric power circuit Ed for fixing to control the temperature of the heater of the heating roll Fh of the fixing device F, i.e., to control the fixing temperature.

C3E: Electric Power Circuit Controller for Cleaning

The electric power circuit controller C3E for cleaning controls the electric power circuit Ee for cleaning to control the voltage applied to the cleaning roll 21 and the collecting roll 22.

C4: Cleaning Roll Rotation Controller (Rotation Cleaning Member Controller)

The cleaning roll rotation controller C4 has an image carrying member thickness detecting unit C4A, a roll rotation speed setting unit C4B, and a cleaning roll motor controller C4C, and controls the rotation of the cleaning rolls 21 provided in the image carrying members PRy to PRk, respectively.

C4A: Image Carrying Member Thickness Detecting Unit (Wear Amount Detecting Unit)

The image carrying member thickness detecting unit C4A has a unit for storing the electric characteristics-thickness relationship C4A1, and the thickness of the image carrying members PRy to PRk, i.e., the extents of wear amounts thereof, for the respective colors, based on the electric characteristics detected with the electric characteristics sensors SN1*y* to SN1*k*. In the image carrying member thickness detecting unit C4A of the embodiment 1, information determining the relationship between the electric characteristics and the thickness, which has been determined by experiments or the like, is stored in the unit for storing the electric characteristics-thickness relationship C4A1, and the thickness is detected by taking such a thickness that corresponds to the electric characteristics detected with the electric characteristics sensors SN1*y* to SN1*k*.

C4B: Roll Rotation Speed Setting Unit (Rotation Cleaning Member Rotation Speed Setting Unit)

The roll rotation speed setting unit C4B has a unit for storing the thickness-rotation speed relationship C4B1, and sets the rotation speeds of the cleaning rolls 21 of the image carrying members PRy to PRk for the respective colors based on the thickness detected with the image carrying member thickness detecting unit C4A. In the roll rotation speed setting unit C4B of the embodiment 1, the relationship between the thickness and the optimum rotation speed, which has been determined by experiments or the like, is stored in the unit for storing the thickness-rotation speed relationship C4B1, and the rotation speeds for the respective colors are set by taking such a rotation speed of the cleaning roll 21 that corresponds to the thickness detected with the image carrying member thickness detecting unit C4A.

C4C: Cleaning Roll Motor Controller

The cleaning roll motor controller C4C controls the operations of the cleaning roll motors M2*y* to M2*k* through the cleaning motor driving circuit D2 based on the rotation speed set with the roll rotation speed setting unit C4B, so as to control the rotation of the cleaning roll 21.

(Description of Flow Chart of Embodiment 1)

(Description of Flow Chart of Operation for Controlling Cleaning Roll Rotation)

Figure 6:
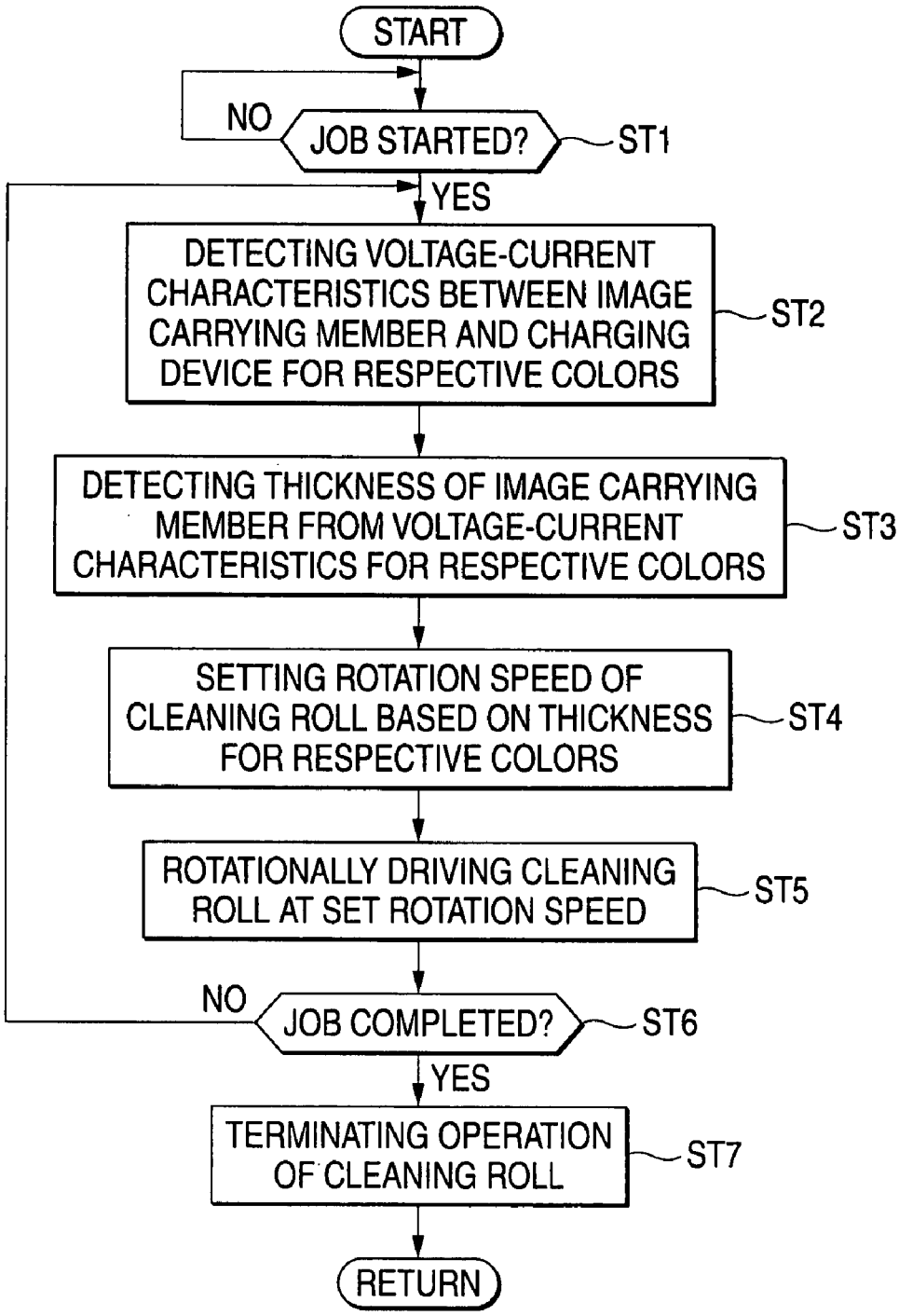
FIG. 6 is an illustrative flow chart of an operation for controlling rotation of a cleaning roll of the embodiment 1.

FIG. 6 is an illustrative flow chart of the operation for controlling rotation of the cleaning roll of the embodiment 1.

The operations of the steps ST in the flow chart shown in FIG. 6 are conducted according to the programs stored in the controller C of the image forming apparatus U. The operations are conducted in parallel to the other operations in the image forming apparatus U.

The operation of the flow chart shown in FIG. 6 is started by turning on the electric power of the image forming apparatus U.

In the step ST1 in FIG. 6, it is determined as to whether or not the job as an image forming operation is started. In the case of yes (Y), the operation proceeds to the step ST2, and in the case of no (N), the operation repeats the step ST1.

In the step ST2, the voltage-current characteristics between the image carrying members PRy to PRk and the charging devices CRy to CRk, i.e., the electric characteristics, are detected for the respective colors. The operation then proceeds to the step ST3.

In the step ST3, the thickness of the image carrying members PRy to PRk is detected for the respective colors based on the voltage-current characteristics. The operation then proceeds to the step ST4.

In the step ST4, the rotation speeds of the cleaning rolls 21 are individually set based on the thickness thus detected. The operation then proceeds to the step ST5.

In the step ST5, the cleaning rolls 21 are rotationally driven at the set rotation speeds. The operation then proceeds to the step ST6.

In the step ST6, it is determined as to whether or not the job is completed. In the case of yes (Y), the operation proceeds to the step ST7, and in the case of no (N), the operation returns to the step ST2.

In the step ST7, the operation of the cleaning roll 21 is terminated. The operation then returns to the step ST1.

(Function of Embodiment 1)

In the image forming apparatus U of the embodiment 1 having the aforementioned constitutional elements, upon forming an image, the surfaces of the image carrying members PRy to PRk are worn by frictioning with the intermediate transfer belt B, the cleaning rolls 21 and the cleaning blades 24, which are in contact with the surface of the image carrying members PRy to PRk. The image carrying members PRy to PRk of the embodiment 1 are improved in service life by providing the protective layer 15 on the surface thereof, and in the case where the wear amount is too small, the surfaces of the image carrying members PRy to PRk are contaminated with a toner to cause deterioration of images, such as blur of images, in some cases. Accordingly, such an extent of friction and wear that is necessary for suppressing blur of images is effected with the cleaning rolls 21 and the cleaning blades 24.

The image forming apparatus U of the embodiment 1 has the plural image carrying members PRy to PRk, and toner images of Y, M, C and K are transferred to the intermediate transfer belt B in this order from the upstream side. Accordingly, in the image carrying member disposed on the downstream side in the rotation direction of the intermediate transfer belt B, the toner image is primarily transferred from the image carrying member to the intermediate transfer belt B, and simultaneously, the toner image of the other color on the upstream side, which has been transferred to the surface of the intermediate transfer belt B, may be reversely transferred, i.e., retransferred. Therefore, on the surface of the image carrying member PRk of K color on the downstream most side, not only the remaining toner of K color is attached thereto, but also the retransferred toners of Y, M and C colors may be attached, and the remaining toner of mixed color is collected with the cleaning roll 21 and the cleaning blade 24. Accordingly, the amount of the toner removed and collected from the image carrying member PRk of K color in the downstream most side is different from the amount of the toner removed and collected from the image carrying member PRy of Y color in the upstream most side. The difference in amount of the toners collected provides different amounts of the toners intervening as a lubricant in the cleaning part, and as a result, the wear amounts are differentiated.

(Description of Difference in Wear Amount)

Figure 7A:
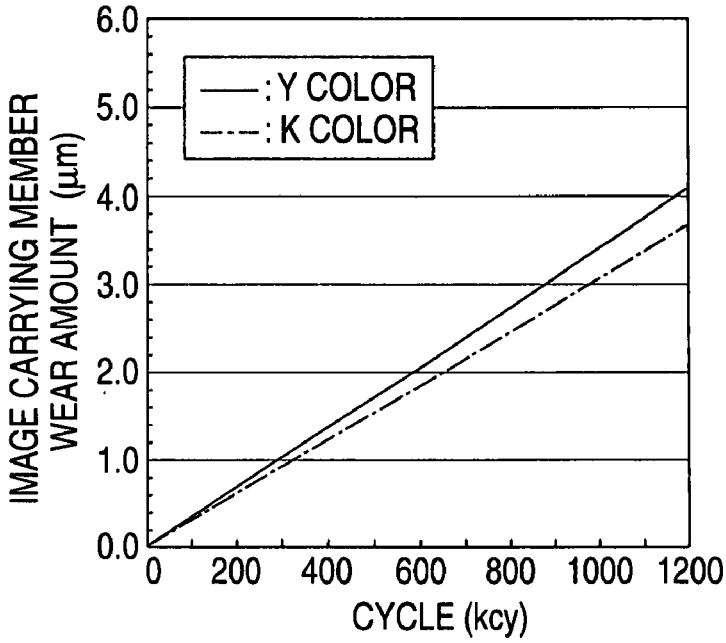
FIGS. 7A and 7B are illustrative views showing graphs on wear amount (μm) of the surface of the image carrying member, in which the abscissa indicates the cumulative revolution number (kcy, kilocycle), and the ordinate indicates the wear amount of the surface of the image carrying member.
Figure 7B:
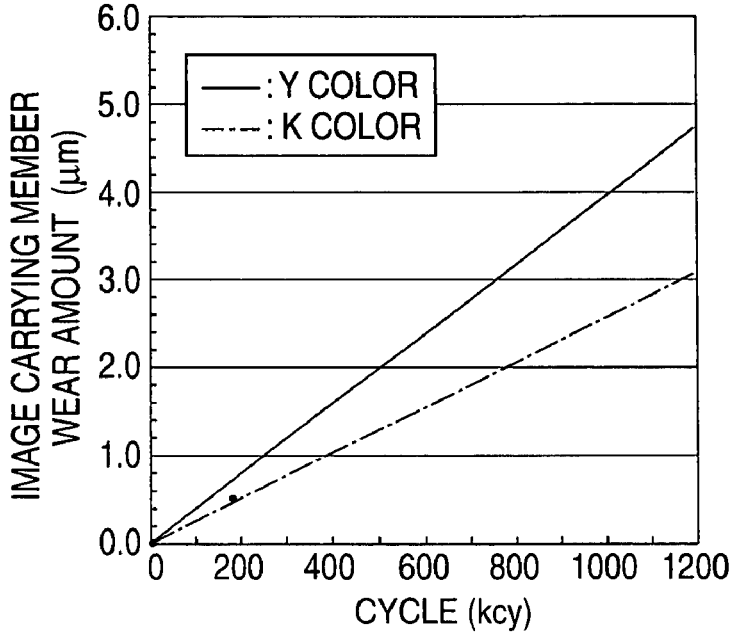

FIG. 7 is an illustrative view of the wear amount (μm) of the surface of the image carrying member, in which the abscissa indicates the cumulative revolution number (kcy, kilocycle=1,000 revolutions), and the ordinate indicates the wear amount of the surface of the image carrying member. FIG. 7A is an illustrative view of the wear amount in the image forming apparatus of the embodiment 1, and FIG. 7B is an illustrative view of the wear amount in an image forming apparatus in the background art.

In FIG. 7, the case of the embodiment 1 and the case in the background art are compared with respect to the relationship between the wear amount of the image carrying member PRy for Y color disposed on the upstream most side and the wear amount of the image carrying member PRk for K color disposed on the downstream most side among the image carrying members PRy to PRk.

For the embodiment 1, the measurement is carried out with a rotation speed of the image carrying members PRy to PRk of 320 mm/s, a rotation speed of the cleaning roll 21*y* for Y color is 250 mm/s, and a rotation speed of the cleaning roll 21*k* for K color of 190 mm/s. In other words, the peripheral speed ratio of the cleaning roll 21*y* for Y color is 0.85, and the peripheral speed ratio of the cleaning roll 21*k* for K color is 0.6, with respect to the image carrying members PRy to PRk. The measurement results are shown in FIG. 7A.

For the example in the background art, the measurement is carried out with a rotation speed of the image carrying members PRy to PRk of 320 mm/s, and a rotation speed of all the cleaning rolls 21$y$ to 21$k$ is 220 mm/s. In other words, the peripheral speed ratio is 0.7. The measurement results of the wear amounts are shown in FIG. 7B.

In FIGS. 7A and 7B, the wear amounts of the surfaces of the image carrying members PRy to PRk are different from each other by colors due to the difference in amounts of toners removed and collected from the image carrying members PRy to PRk and the difference in component characteristics of the toners by colors. That is, the toner attached to the surfaces of the image carrying members PRy to PRk has a function like a lubricant upon cleaning, and, as shown in FIG. 7B, the wear amounts of the surfaces of the image carrying members are different from each other between the image carrying member PRy on the upstream most side and the image carrying member PRk on the downstream most side due to the amounts and characteristics of the toners. For example, after 1,000 kcy, i.e., 1,000,000 revolutions, in FIG. 7B, the wear amount of the image carrying member PRy for Y color is about 4.0 μm, and the wear amount of the image carrying member PRk for K color is about 2.6 μm, which provides a difference of about 1.4 μm.

In the image forming apparatus U of the embodiment 1, on the other hand, the thickness of the image carrying members PRy to PRk, which indirectly indicates the wear amounts with respect to the initial thickness, is detected, and the rotation of the cleaning roll 21 is controlled corresponding to the wear amounts thus detected, whereby the wear amounts of the image carrying members PRy to PRk are made close to each other. For example, after 1,000,000 revolutions, in FIG. 7A, the wear amount of the image carrying member PRy for Y color is about 3.4 μm, and the wear amount of the image carrying member PRk for K color is about 3.1 μm, which provides a difference of about 0.3 μm.

Upon changing the rotation speed of the cleaning roll 21, the wear amounts are changed corresponding to the peripheral speed with respect to the image carrying members PRy to PRk. By utilizing the relationship, for example, with the rotation speed of the cleaning roll 21 for the image carrying member exhibiting the maximum wear amount being constant, the cleaning roll 21 for the image carrying member exhibiting a small wear amount is set at a rotation speed providing such a peripheral speed ratio that corresponds to the difference to the maximum wear amount, or in alternative, the rotation speed of the cleaning roll 21 for the image carrying member exhibiting the maximum wear amount is set at a rotation speed making the wear amount small, i.e., the rotation speed is set close to a peripheral speed ratio of 1, whereby the wear amounts of the image carrying members can be made close to each other. In the embodiment 1, particularly, the rotation speed is not set in advance based on prediction, but the rotation speed is set based on the thickness that is actually detected, and thus the wear amounts are uniformized with high accuracy.

In the image forming apparatus of the embodiment 1, irregular inorganic particles having a Mohs hardness of 3 or more and a volume average particle diameter of about from 0.1 to 1.0 μm are added as an external additive to the developer, and the cleaning roll 21 having the irregular inorganic particles retained therein frictions on the image carrying members PRy to PRk. Accordingly, the surfaces of the image carrying members PRy to PRk are grounded with the cleaning roll 21 having the hard particles having a minute diameter retained therein.

Embodiment 2

An exemplary embodiment 2 will be described below, and in the description of the embodiment 2, and constitutional elements corresponding to the constitutional elements of the embodiment 1 are attached with the same symbols to omit detailed descriptions thereof.

The embodiment 2 is different from the embodiment 1 in the following points, and is constituted in the same manner as in the embodiment 1 in the other points.

In the embodiment 2, irregular inorganic particles having a Mohs hardness of 3 or more and a volume average particle diameter of about from 0.1 to 2.0 μm are added as an external additive to the developer.

In the embodiment 2, the cleaning blade 24 is constituted by elastic rubber having a 100% modulus of about from 6.2 to 19.6 MPa. The 100% modulus is measured by a measuring method according to JIS K6301 (physical test method for vulcanized rubber), which indicates a stress upon 100% elongation under an environment of 23° C.

(Function of Embodiment 2)

Figure 8:
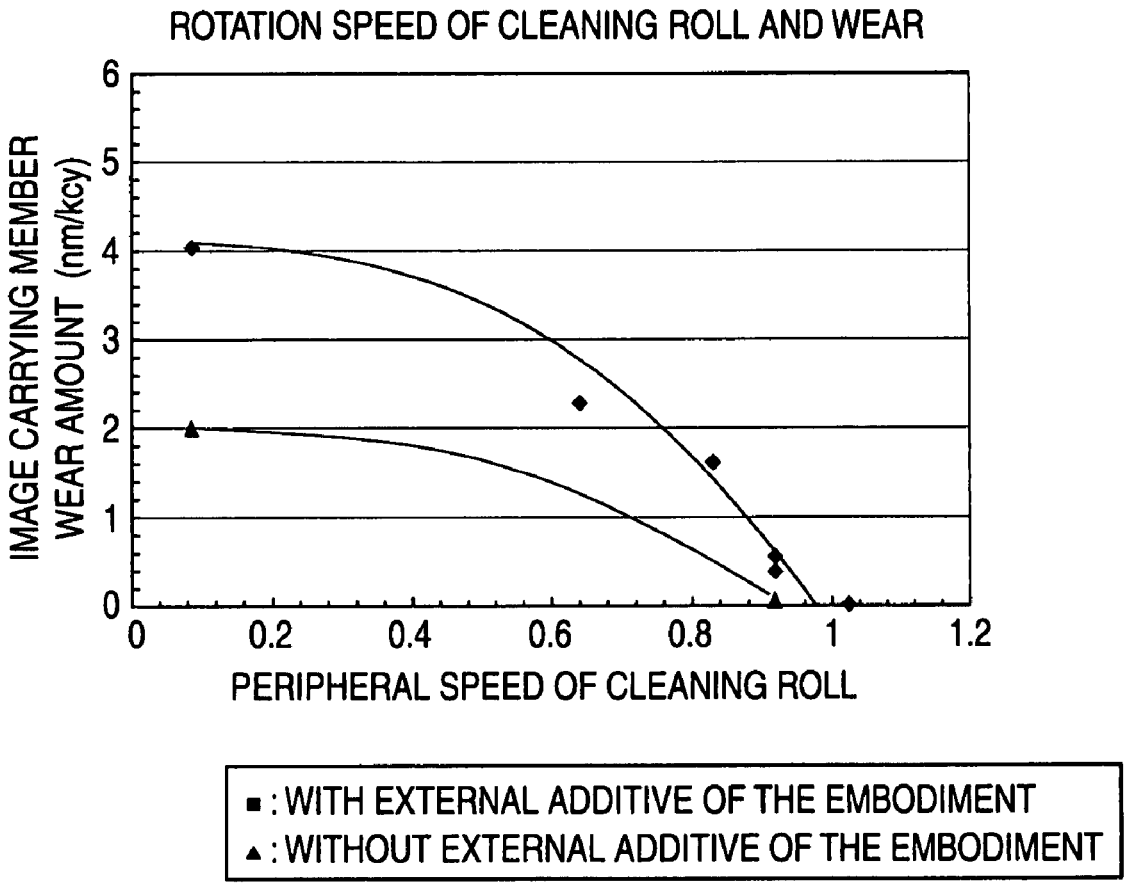
FIG. 8 is an illustrative view showing the relationship between the peripheral speed ratio of the cleaning roll with respect to the image carrying member and the wear amount (nm/kcy) per 1 kcy of the image carrying member, which is a graph, in which the abscissa indicates the peripheral speed ratio of the cleaning roll, and the ordinate indicates the wear amount of the image carrying member.

FIG. 8 is an illustrative view showing the relationship between the peripheral speed ratio of the cleaning roll with respect to the image carrying member and the wear amount (nm/kcy) per 1 kcy of the image carrying member, which is a graph, in which the abscissa indicates the peripheral speed ratio of the cleaning roll, and the ordinate indicates the wear amount of the image carrying member.

In the image forming apparatus U of the embodiment 2 having the aforementioned constitution, the irregular inorganic particles having a Mohs hardness of 3 or more and a volume average particle diameter of about from 0.1 to 2.0 μm are externally added to the developer, whereby the wear amount owing to the cleaning roll 21, i.e., the grinding property thereof, can be improved as compared to no external additive is added, as shown in FIG. 8, and thus the wear amount can be controlled with high accuracy.

According to the constitution, the cleaning roll 21 for the image carrying member on the downstream side, which exhibits a relatively small wear amount due to the lubrication function of the retransferred toner, wears the surface of the image carrying member at a larger extent than the cleaning roll 21 for the image carrying member on the upstream side, which exhibits a relatively large wear amount.

Figure 9:
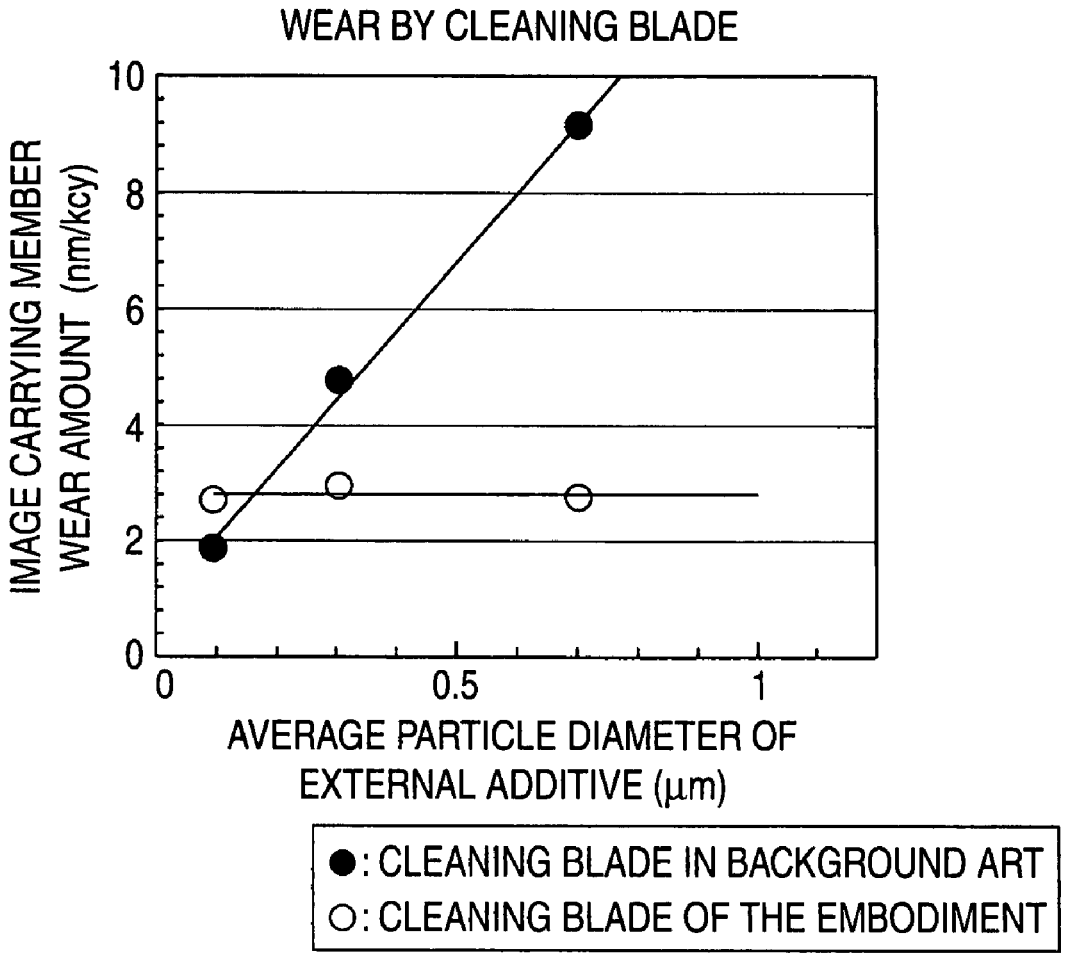
FIG. 9 is an illustrative view of wear owing to the cleaning blade of an exemplary embodiment 2, which is a graph, in which the abscissa indicates the average particle diameter (μm) of the external additive, and the ordinate indicates the wear amount (nm/kcy) of the image carrying member.

FIG. 9 is an illustrative view of wear owing to the cleaning blade of the embodiment 2, which is a graph, in which the abscissa indicates the average particle diameter (μm) of the external additive, and the ordinate indicates the wear amount (nm/kcy) of the image carrying member.

Figure 10A:
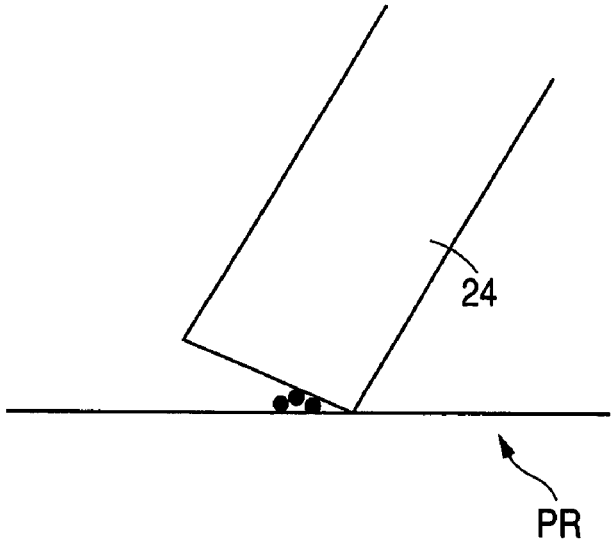
Figure 10B:
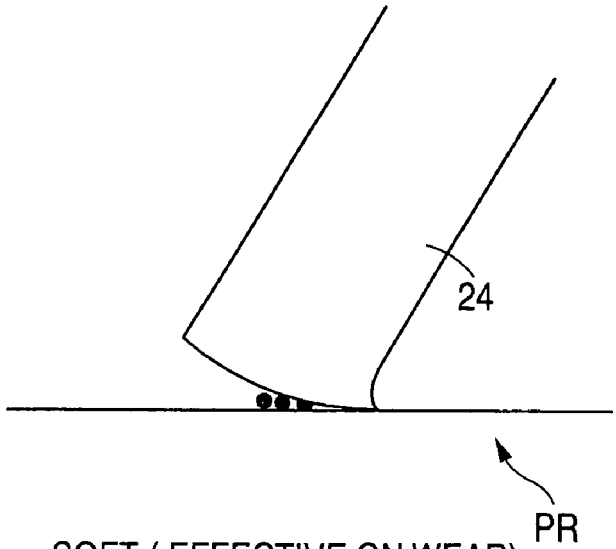

FIG. 10 is an illustrative view of the wear property of the cleaning blade of the embodiment 2, in which FIG. 10A is an illustrative view of the cleaning blade of the embodiment 2, and FIG. 10B is an illustrative view of a cleaning blade in the background art.

In FIGS. 8 to 10, since the cleaning blade 24 having a 100% modulus of about from 6.2 to 19.6 MPa is used in the image forming apparatus of the embodiment 2, it is harder than a cleaning blade 24 having been employed in the background art, and the tip end of the blade is difficult to deform as shown in FIG. 10A, as compared to the case in the background art, shown in FIG. 10B, in which the 100% modulus is lower than about 6.2 MPa. Accordingly, in the cleaning blade 24 of the embodiment 2, the external additive and the toner entering in the space with a wedge shape between the tip end of the blade and the surface of the image carrying member are difficult to be pressed by the cleaning blade 24 onto the surface of the image carrying member as compared to the cleaning blade in the background art, and thus it has a small function of wearing the surface of the image carrying member. Therefore, in the image forming apparatus U of the embodiment 2, even in the case where irregular inorganic particles having a Mohs hardness of about 3 or more and a volume average particle diameter of about from 0.1 to 2.0 μm, i.e., irregular fine particles having a larger diameter than the embodiment 1, are used in the developer, the influence of the fine particles having a large diameter by the cleaning blade 24 is suppressed.

As shown in FIG. 9, accordingly, irrespective to the volume average particle diameter of the external additive, or in other words, even when fine particles having a larger diameter exhibiting high controllability of grinding upon retained by the cleaning roll 21 are used, the wear amounts of the image carrying members with the cleaning blade 24 of the embodiment 2 are not changed, and there is substantially no change in wear due to the cleaning blade 24 between the image carrying member on the upstream side and the image carrying member on the downstream side. Consequently, the difference in wear amount of the image carrying members PRy to PRk mainly depends on wear due to the cleaning roll 21, and the influence of wear due to the cleaning blade 24 is small.

Modified Embodiments

The invention has been described in detail with reference to the embodiments, but the invention is not limited to the embodiments, and various changes may be made within the scope of the gist of the invention described in the scope of claim. Modified embodiments (H01) to (H08) of the invention are shown below.

(H01) While a duplicator/printer is exemplified as the image forming apparatus in the example, the invention is not limited thereto, and the image forming apparatus may be a facsimile machine, a printer or a complex machine having all or plural functions among them.

(H02) While such a constitution is exemplified in the examples that the thickness is detected by detecting the peak voltage of the alternating current of the charging voltage controlled to a constant current, but the invention is not limited thereto, and arbitrary thickness detecting methods including a contact type and a non-contact type. For example, in the case where it is controlled to a constant current corresponding to the use environment, such as temperature and humidity, it is possible that the thickness is detected in consideration of the gradient of change of the peak voltage of the alternating current voltage, and the thickness is detected based on the change in electric characteristics between the primary transferring device, but not the charging device, and the image carrying member. In the case where the change in electric characteristics is detected in the primary transferring device, the charging device is not limited to a charging roll of a contact type, and a corotron or a scorotron of a corona discharge type may be employed.

(H03) While the thickness is continuously detected in the examples, the invention is not limited thereto, and it is possible that the thickness is detected at a prescribed timing, for example, per 1,000 revolutions of the image carrying member, for setting the rotation speed of the cleaning roll. Furthermore, without detection of the thickness, the relationship between the number of printed sheets for the respective image carrying member (or the number of revolution of the image carrying member or the time of revolution of the image carrying member) and the wear amounts are obtained experimentally and stored in a storing unit, and the suitable rotation speed is set corresponding to the cumulative printed number based on the relationship.

(H04) While the cleaning roller using a nonwoven fabric or the like is used in the examples, invention is not limited thereto, and an arbitrary rotation cleaning member, such as a cleaning brush, for an image carrying member may be employed. Furthermore, while a nonwoven fabric using electroconductive fibers is exemplified, the invention is not limited thereto, and a cleaning roller using an insulating nonwoven fabric may be employed. In the case where an insulating nonwoven fabric is employed, the collecting roll 22 and the scraper 23 may be omitted, and only the cleaning roll of an insulating nonwoven fabric may be frictioned with the toner component retained in the fine and porous structure of the nonwoven fabric.

(H05) While the exemplified external additive is preferably added in the examples, such a constitution may be employed that no external additive is used, but the rotation of the cleaning roller is controlled in consideration of the influence of the external additive.

(H06) While the cleaning blade 24 preferably has the exemplified 100% modulus in the examples, such a constitution may be employed that a cleaning blade of other types is used, and the rotation of the cleaning roller is controlled in consideration of the wear amount due to the cleaning blade, and furthermore, the cleaning blade may be omitted. In the case where the 100% modulus is 19.6 MPa, i.e., 200 kgf/cm$^2$, or more, when scratch flaws are formed on the surface of the image carrying member, the rubber insufficiently follows the unevenness to increase a possibility of causing cleaning failure, particularly in the case where a spherical toner is used, and therefore, a cleaning blade of 19.6 MPa or less is preferably used. In the case where the 100% modulus is less than 6.2 MPa, on the other hand, the tip end of the blade is further liable to be deformed under stress conditions, such as continuous printing of low density images. The cleaning blade 24 has increased capability of pressing the external additive and the toner entering in the space with a wedge shape between the tip end of the blade and the surface of the image carrying member onto the surface of the image carrying member, and the influence of the wear amount by the cleaning blade is increased. Accordingly, a cleaning blade having a 100% modulus of 6.2 MPa or more is preferably used.

(H07) In the examples, the constitution of the image carrying member is not limited to the constitutions shown in the examples, and an arbitrary constitution may be employed. For example, the undercoating layer 12 may be omitted, and the protective layer 15 may also be omitted while it is preferably provided.

(H08) While the image carrying members PRy to PRk are disposed in the order of Y, M, C and K from the upstream side in the rotation direction of the intermediate transfer belt B in the examples, the invention is not limited thereto, and the order thereof may be arbitrarily changed. Furthermore, such a constitution may be employed that no intermediate transfer belt B is used, but images are transferred from the image carrying members PRy to PRk directly to the medium, or an intermediate transfer drum is used. Moreover, the number of the image carrying members PRy to PRk is not limited to 4, i.e., not limited to four colors, and 3 or less colors or 5 or more colors may be used.

What is claimed is:

1. An image forming apparatus comprising:

a plurality of image carrying members;

a detector that detects the wear amounts of the respective image carrying members;

a plurality of rotation cleaning members disposed for the respective image carrying members and cleaning surfaces of the respective image carrying members through rotation;

a controller that rotates the plurality of rotation cleaning members at different rotation speeds in accordance with wear amounts of the respective image carrying members such that a speed of each rotation cleaning member in relation to the speeds of the other rotation cleaning members corresponds with a wear amount of the corresponding image carrying member in relation to the wear amounts of the other image carrying members and such that a wear amount of each of the image carrying members is close to a wear amount of each of the other image carrying members; and scraping members, each being disposed on a downstream side of the corresponding rotation cleaning member in a rotation direction of the corresponding image carrying member, scraping an attachment on a surface of the image carrying member, and having a 100% modulus of about 6.2 to 19.6 MPa.

2. The image forming apparatus according to claim 1, further comprising:

a rotation speed setting unit that sets rotation speeds of the rotation cleaning members based on the wear amounts detected, wherein the controller rotates the plurality of rotation cleaning members at the rotation speeds, and each of the plurality of image carrying members includes a protective layer as an outermost layer thereof, the protective layer having a charge transporting function.

3. The image forming apparatus according to claim 1, wherein each of the image carrying members forms a visual image on a surface thereof with a developer containing irregular inorganic fine particles, the irregular inorganic fine particles having a Mohs hardness of about 3 or more and a volume average particle diameter of about from 0.1 to 1.0 μm.

4. The image forming apparatus according to claim 1, wherein each of the rotation cleaning members includes a fiber layer as outermost layer, the fiber layer containing fine fibers.

5. A method for cleaning surfaces of image carrying members in an image forming apparatus, comprising:

detecting wear amounts of the respective image carrying members;

setting rotation speeds of rotation cleaning members in accordance with the wear amounts such that a speed of each rotation cleaning member in relation to the speeds of the other rotation cleaning members corresponds with a wear amount of the corresponding image carrying member in relation to the wear amounts of the other image carrying members and such that a wear amount of each of the image carrying members is close to a wear amount of each of the other image carrying members, the rotation speeds being different from one another;

rotating the rotation cleaning members at the rotation speed to clean the surfaces of the image carrying members; and scraping an attachment on a surface of the image carrying member by using scraping members, each being disposed on a downstream side of the corresponding rotation cleaning member in a rotation direction of the corresponding image carrying member and having a 100% modulus of about 6.2 to 19.6 MPa.

6. The image forming apparatus according to claim 1, wherein each of the image carrying members forms a visual image on a surface thereof with a developer containing irregular inorganic fine particles, the irregular inorganic fine particles having a Mohs hardness of about 3 or more and a volume average particle diameter of about from 0.1 to 1.0 μm.

* * * * *